United States Patent [19]

Zulauf

[11] Patent Number: 5,060,791

[45] Date of Patent: Oct. 29, 1991

[54] TWO-CHAMBER CONTAINER

[75] Inventor: Karlheinz Zulauf, Höchst-Hassenroth, Fed. Rep. of Germany

[73] Assignee: Goldwell GmbH, Darmstadt-Eberstadt, Fed. Rep. of Germany

[21] Appl. No.: 457,803

[22] PCT Filed: Feb. 20, 1989

[86] PCT No.: PCT/EP89/00155

§ 371 Date: Dec. 28, 1989

§ 102(e) Date: Dec. 28, 1989

[87] PCT Pub. No.: WO89/09736

PCT Pub. Date: Oct. 19, 1989

[30] Foreign Application Priority Data

Apr. 14, 1988 [DE] Fed. Rep. of Germany ..... 3812343
Nov. 5, 1988 [DE] Fed. Rep. of Germany ..... 3837595

[51] Int. Cl.[5] ..... B65D 25/08

[52] U.S. Cl. ..... 206/221; 206/219; 215/DIG. 8

[58] Field of Search ..... 206/219, 221; 222/142.5, 145, 545; 215/DIG. 8

[56] References Cited

U.S. PATENT DOCUMENTS

| | | | |
|---|---|---|---|
| 3,070,093 | 12/1982 | Sarnoff et al. | 206/221 |
| 4,024,952 | 5/1977 | Leitz | 206/221 |
| 4,132,308 | 1/1979 | Goncalves | 206/219 |
| 4,203,517 | 5/1980 | Hildebrandt et al. | 206/221 |
| 4,465,183 | 8/1984 | Saito et al. | 215/DIG. 8 |
| 4,483,439 | 11/1984 | Steigerwald et al. | 206/219 |
| 4,690,304 | 9/1987 | Morel | 222/545 |
| 4,747,517 | 5/1988 | Hart | 206/221 |
| 4,793,475 | 12/1988 | Itzel | 206/221 |
| 4,875,577 | 10/1989 | Hildebrandt et al. | 206/219 |
| 4,903,828 | 2/1990 | Finke et al. | 206/221 |

FOREIGN PATENT DOCUMENTS

| | | | |
|---|---|---|---|
| 2200536 | 7/1973 | Fed. Rep. of Germany | 206/219 |
| 2569666 | 3/1986 | France | 206/219 |
| 365021 | 11/1962 | Switzerland | 206/221 |
| 1436648 | 5/1976 | United Kingdom | 215/DIG. 8 |

*Primary Examiner*—David T. Fidei

[57] ABSTRACT

The invention relates to a two-chamber container in which two separate components are to be mixed together to make a ready-to-use preparation before it is dispensed from the container, and which are contained in two chambers, an upper container and a lower container chamber, disposed one above the other in a container housing. The container chambers are connected to one another by a passage running from the top of the lower container chamber into the bottom of the upper container chamber. A separating plug stops this passage. The plug can be displaced into one of the container chambers by a plunger element which can be displaced in a vertical direction from the outside, so that the components can flow together and be mixed with one another within the container.

15 Claims, 2 Drawing Sheets

TWO-CHAMBER CONTAINER

BACKGROUND OF THE INVENTION

1. Field of the Invention

The invention relates to a two-chamber container for holding two separate components which are to be mixed together to make a ready-to-use preparation before it is dispensed from the container, and which are contained in two chambers disposed one above the other in a container housing, the container chambers being connected to one another by a passage running from the top of the lower container chamber into the bottom of the upper container chamber. This passage is stopped by a separating plug which can be displaced into one of the container chambers by a plunger element which can be displaced in the vertical direction from the outside, so that the components can flow together and be mixed with one another.

2. Description of the Prior Art

If a measured amount of a preparation of two components reacting with one another cannot be prepared until immediately before use, because the preparation otherwise becomes unusable for the intended purpose after any relatively great length of reaction time, the individual components are best loaded into separate chambers of such two-chambered containers, in order to assure that, after the preparation is ready, it will contain the components in the prescribed quantity ratio. If the amount of one of the components is small in comparison to the other component, as is often the case with pharmaceutical preparations for example, it is possible to integrate the chamber for the smaller component into the closure of the container holding the other component. We speak then of so-called "active ingredient chamber closures," of which many varieties are known. Among them are closures in which the active ingredient chamber has a tubular plunger acting as a punch on the previously scored chamber bottom, which before the closure is removed from the main container is pushed into the active ingredient chamber thus punching out the bottom of the active ingredient chamber, which then drops into the main container. The active ingredient then likewise enters into the main component and can be mixed with the latter by shaking or stirring with an appropriate instrument. After the complete removal of the active ingredient chamber closure the preparation can then be used. The problem becomes more difficult when the preparation has to be made up of comparable amounts of two components, since then the chamber must have such a capacity for the second component that it can no longer be integrated into the container closure. Cases like this can be encountered, for example, in cosmetic preparations, e.g., the making up of a ready-to-use hair dye emulsion from the actual dye component in paste form and the liquid oxidant (hydrogen peroxide), or also where the mixing of liquid or paste plastic resins with a hardener is involved. Another application is the packaging of certain liquid permanent waves which due to the incompatibility of the components can be mixed with one another only just before use, i.e., before the permanent wave preparation is applied to the customer's hair. For such cases two-chamber containers of the kind mentioned above have been developed (DE-OS 35 28 525) in which the two container chambers are made separately and then joined together to make the complete container before or after filling with the components of the preparation. The separating plug shutting the two chambers off from one another can be forced out of the connecting passage by pressing on a plunger with an accessible external handle, driving the plug into the upper container chamber. This known two-chamber container has proven useful basically for application-unit packaging and storage as well as for the preparation and application of liquid cosmetic binary preparations, but due to its complex construction and difficult assembly it is relatively expensive. Moreover, with this known container it is not possible to make sure that the plunger will not be accidentally and unintentionally actuated by heedless handling, causing the two components to come in contact and react with one another. The preparation can then no longer be used.

SUMMARY OF THE INVENTION

The invention is addressed to the problem of creating a two-chamber container of simple construction and therefore inexpensive to manufacture, which can be manufactured and filled simply and quickly and at the same time assure better handling that will be safer from unintentional operation of the plunger.

Setting out from a two-chamber container of the kind mentioned above, this problem is solved in accordance with the invention by the fact that the plunger is an elongated applicator nozzle fixedly attached to the separating plug and extending through the upper container chamber and into its open mouth, the hollow interior of the nozzle opening at its bottom end into the lower container chamber through the separating plug and at its top end into an applicator orifice; that the plunger element is provided on its exterior with an external screw thread which is engaged with a complementary screw thread which is formed in a cylindrical annular projection reaching into the open top of the upper container chamber from the end wall of a turning cap at least partially overlapping the upper container chamber, held rotatably thereon and sealing it off; that the portion of the end wall of the turning cap situated inside of the annular projection is so configured that, when the turning cap is rotated in the sense of screwing the applicator nozzle into the annular projection, it can be forced out of the end wall by the free end of the applicator nozzle, and that the section of the applicator nozzle directly adjoining the separating plug has an external sealing surface which, in the fully unscrewed position of the applicator nozzle, seals against a complementary sealing surface formed on the annular projection. The plunger element in the two-chamber container thus constituted is thus simultaneously in the form of an applicator nozzle. By turning the turning cap the separating plug can be drawn out of the connecting passage as a result of the threaded engagement with the applicator nozzle, so that then the preparation component contained in the upper container chamber passes into the preparation component contained in the lower container chamber, and by shaking the container it can be mixed with the latter to make the ready-to-use preparation. The free end of the applicator nozzle fully deployed out of the upper container chamber then protrudes from the turning cap, and the preparation can be dispensed only from the applicator orifice of the applicator nozzle, since the turning cap is sealed in the mouth of the upper container chamber and the applicator nozzle is sealed against the turning cap by its sealing surface in contact with the complementary sealing surface of the annular projection. Unlike the case with known two-chamber containers, the separating plug can be returned into the connecting passage by screwing the applicator nozzle back again and the passage will thus be closed if this is desired in the case of a temporary interruption of the process of applying the preparation.

To prevent the separating plug and the applicator nozzle connected therewith from turning when the turning cap is turned, it is recommended, in a further development in accordance with the invention, to provide cooperating abutment means on the separating plug on the one hand and in the upper container chamber on the other; such means will prevent such turning but allow longitudinal displacement of the separating plug into the upper container chamber.

The abutment means will then best have at least one projection extending from the separating plug substantially radially to the circumferential wall of the upper container chamber, and at least one rib projecting inwardly and extending substantially over its entire height, which will be contacted by the radial projection of the separating plug when a rotary movement is performed.

For the sake of simple and inexpensive manufacture, the container is best made in one piece from plastic by the blow-molding method. By using a resiliently deformable plastic and making the wall thickness of the container appropriate, it can then be made possible for the container to be compressed resiliently for the controlled and measured application of the ready preparation.

In an advantageous further development of the invention, the configuration can be made such that the turning cap completely overlaps the upper container chamber and has at its lower end at least one radially inwardly projecting bead reaching below the bottom of the upper container chamber. The turning cap is therefore installed simply by snapping it over the upper container chamber.

In the area of the transition from the bottom of the container chamber to its circumferential wall it is then desirable to provide an annular circumferential bead which can be engaged by the [inwardly projecting] bead [of the turning cap] and which holds the bottom, open end of the turning cap in a largely clearance-free manner. For sealing the turning cap in the upper container chamber it is desirable to provide an annular wall projecting from the inside surface of the end wall of the turning cap into the mouth of the upper container chamber and sealing in the manner of a hollow stopper in this mouth.

The turning cap in turn is best injection molded from plastic, while the portion of the end wall which can be pushed out when the applicator nozzle is deployed is an integral part of the turning cap end wall contained within an annular circumferential score.

A plug can best extend from the inside surface of the turning cap end wall facing the applicator nozzle, into the applicator orifice of the applicator nozzle. Then, even in the case of a temporary interruption of the application process, when the applicator nozzle is withdrawn, the plug can be pushed into its applicator orifice, thereby preventing the access of ambient air to the preparation.

The separating plug and the applicator nozzle are also best injection molded in one piece from plastic.

The sealing surfaces which cooperate when the applicator nozzle is deployed are preferably formed by substantially complementary cylindrical sealing surfaces on the applicator nozzle and in the annular projection of the turning cap, the diameter of the sealing surface formed on the applicator nozzle being at least equal to, and preferably slightly greater than the inside diameter of the sealing surface formed in the annular projection.

An advantageous further development of the container according to the invention is characterized by the fact that the applicator nozzle has on its applicator orifice end ahead of the section provided with the external thread a conically tapering section, that a radially circumferential ledge projects from the inner wall of the annular projection to such a distance that the inside diameter remaining within the annular projection is approximately equal to or slightly smaller than the root diameter of the external thread of the applicator nozzle, and that the ledge projects in an area situated underneath the unthreaded conical section of the applicator nozzle from the inner wall of the annular projection when the turning cap is properly installed and the container chambers are shut off from one another by the separating plug. When the turning cap is placed on the (filled) upper container chamber, the conically tapering section on the free end of the plunger element thus enters into the annular projection of the turning cap and passes through the opening left free within the radially circumferential ledge, while the first spiral of the external screw thread of the applicator nozzle passes through the ledge at a point, with deformation of the ledge at this point, and thus forms the counter-thread in the annular projection.

The end wall of the turning cap, in a preferred further development of the invention, is provided with an opening in the area of the annular projection provided on the inside, which is sealed by a stopper which can be forced out of the opening by the free end of the applicator nozzle when the latter is deployed. The interior of the annular projection in the turning cap thus configured is therefore accessible from the top as well as the bottom, which simplifies the manufacture of the injection mold for the turning cap, especially in the area of the ledge that is to be produced inside of the annular projection.

Then, when the opening in the turning cap is closed by a stopper, a configuration is recommended in which a pin protrudes from the inside surface of the stopper facing the applicator nozzle and fits into the applicator orifice of the applicator nozzle, and prevents the unintentional escape of the filling component charged into the lower container chamber.

The sealing surface in the turning cap, which is complementary to the outer sealing surface of the separating plug, and which in the case of the two-chamber container according to the principal application is formed in the annular projection provided with the complementary thread, is, in a desirable further development of the invention, formed by the inner surface of a second annular projection of increased diameter projecting from the inside of the end wall of the turning cap.

BRIEF DESCRIPTION OF THE DRAWINGS

The invention is further explained in the following description in conjunction with the drawing, wherein.

DESCRIPTION OF THE PREFERRED EMBODIMENT

Figure 1:
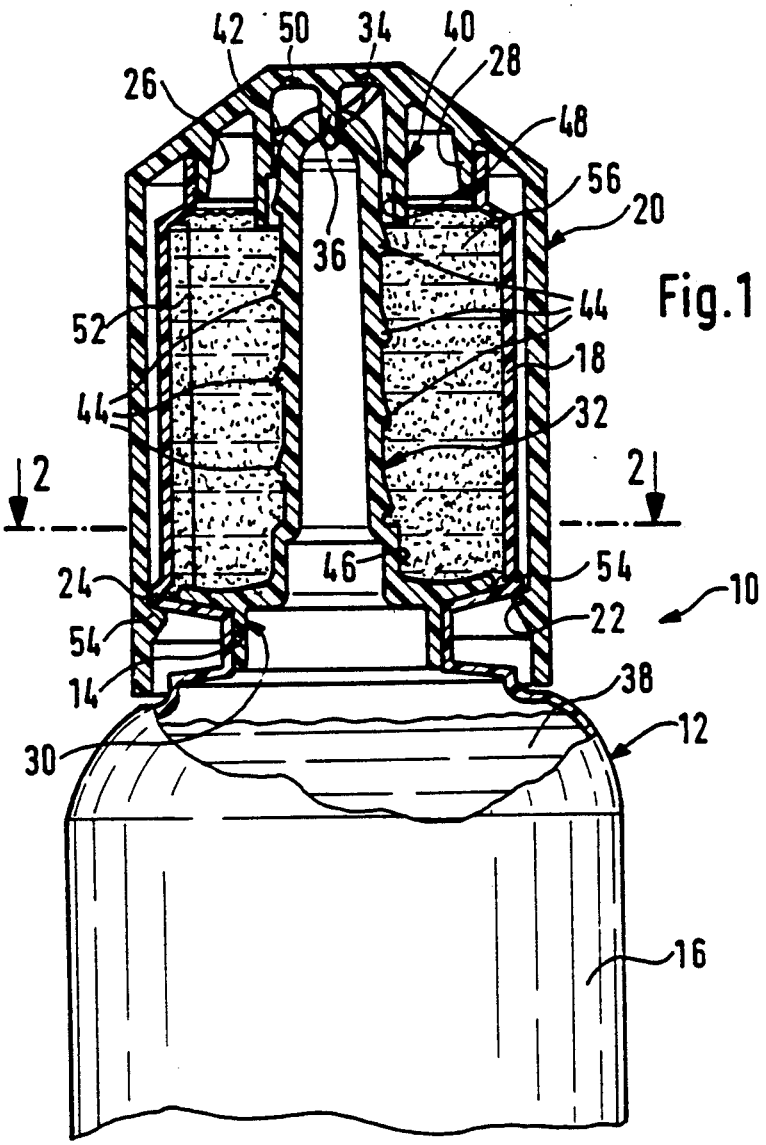
FIG. 1 is a partially cut-away side elevation of the upper part of a two-chamber container in accordance with the principal application, the section plane of the sectioned part being indicated in FIG. 2 by the arrows 1—1.
Figure 2:
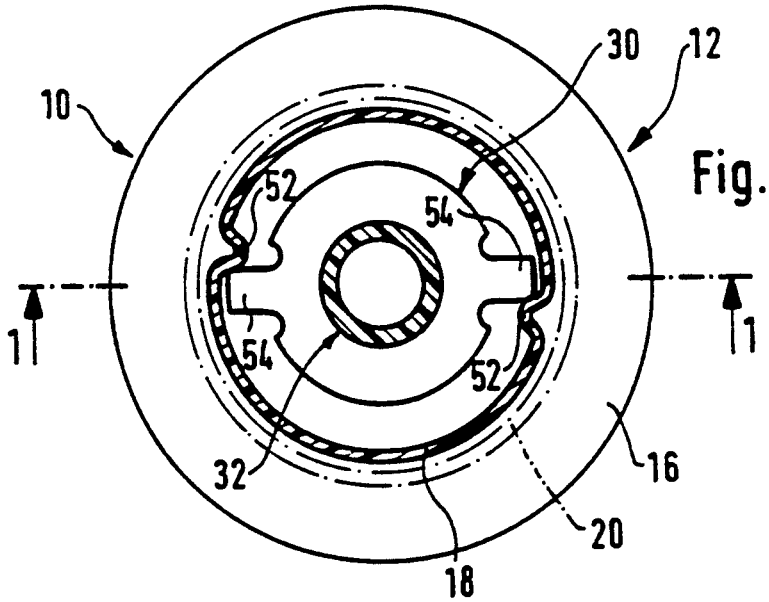
FIG. 2 is a cross section seen in the direction of the arrows 2—2 in FIG. 1.
Figure 6:
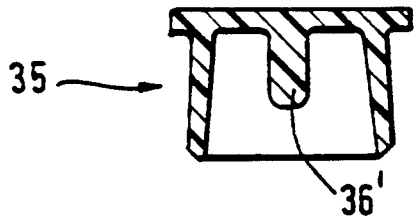
FIG. 6 is a cross section through a plug closing simultaneously the opening in the turning cap and the applicator orifice in the plunger element.
Figure 3:
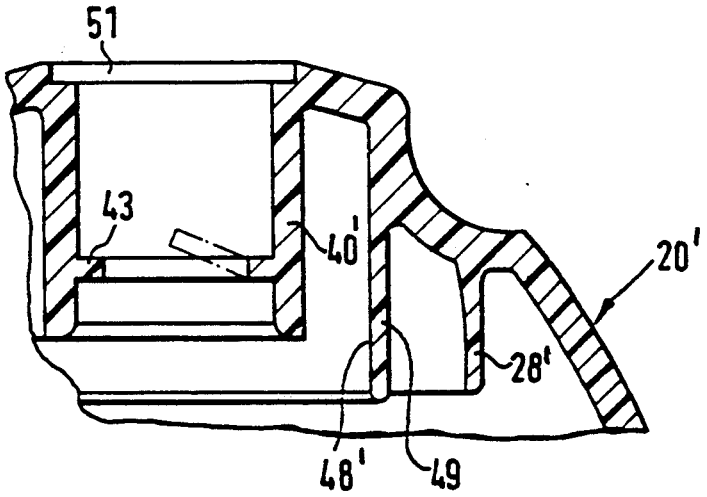
FIG. 3 is a cross section corresponding to the cross section in FIG. 1, taken through a portion of the turning cap of the two-chamber container further developed in the manner of the invention.
Figure 4:
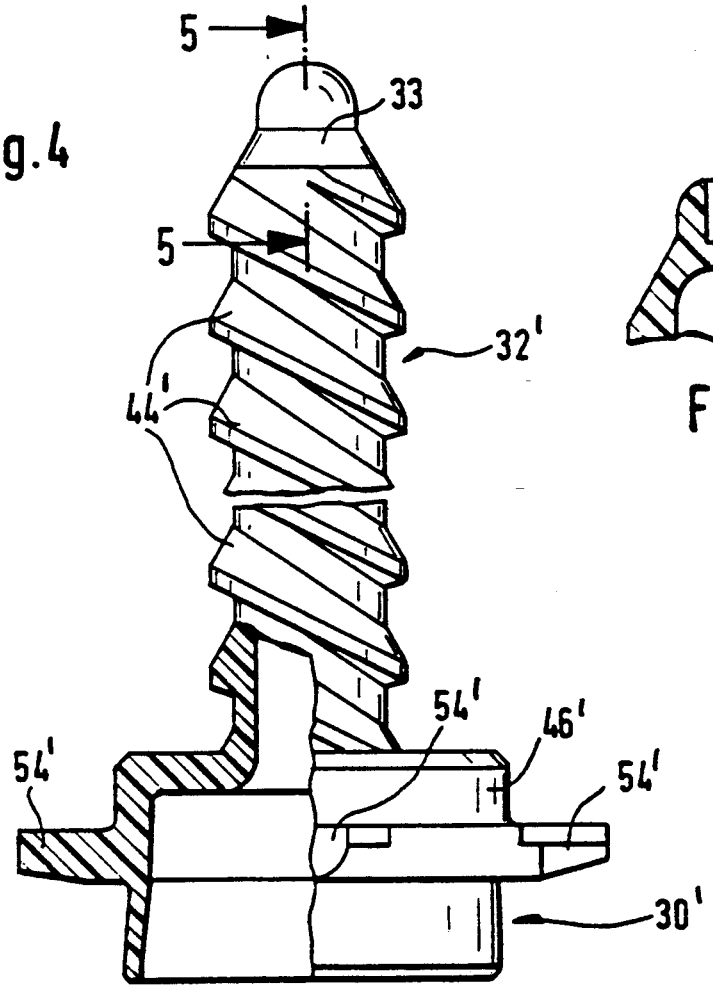
FIG. 4 is a perspective side elevation, partially cut away in the area provided with the separating plug, of the plunger element simultaneously constituting the applicator nozzle of the further-developed two-chamber container.
Figure 5:
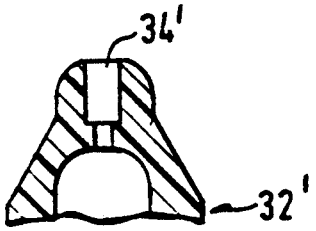
FIG. 5 is a fragmentary cross section through the free front end of the plunger element that is provided with the applicator orifice, seen in the direction of the arrows 5—5 in FIG. 4.

The two-chamber container represented in FIGS. 1 and 2 and identified in its entirety by the number 10 has a container 12 made by blow-molding from plastic, which is composed of two container chambers 16 and 18 integrally connected together by a connecting passage 14 of reduced diameter. The connecting passage 14 of circular cross section thus constitutes the upper mouth of the lower container chamber 16 of which only the upper part is represented in FIG. 1, and constitutes an opening in the bottom of the upper container chamber 18, by which, therefore, the two chambers 16 and 18 are connected together.

The upper container chamber 18 is completely overlapped by a turning cap 20 which is rotatable due to a catch means 22 in the form of a circumferential bead in the case represented in the figures of the drawing, which extends from the inner wall of the turning cap 20 and catches on the bottom of the upper container but is securely held on the container chamber 18 against removal therefrom. Instead of the annularly circumferential catch means 22, it would of course also be possible to provide two or more catch means in the form of individual projections extending from the inner wall of the turning cap at equal angular intervals apart. The area of transition from the bottom to the circumferential wall of the upper container chamber 18 is formed into a circumferential, radially projecting annular bead 24 whose outside diameter is approximately equal to the inside diameter of the turning cap 20. The upper container chamber which terminates at the top in a cylindrical mouth 26 of reduced diameter, is sealingly closed by an annular rim 28 projecting from the inner surface of the end wall of the turning cap 20 and entering the mouth 26 in the manner of a hollow plug which is preferably of the shape of a so-called "Dichtolive" [sealing plug] indicated in FIG. 1, whose outer circumference lies against the inner wall of the mouth 26 with slight bias so that, on the one hand a reliable seal is obtained, and on the other hand no great resistance is developed when the turning cap 20 is rotated.

After the bottom container chamber 16 has been filled, a separating plug 30 of plastic is inserted into the connecting passage 14 through the mouth 26 and seals off the container chambers 16 and 18 from one another; from its upper side an elongated plunger element, referred to hereinafter as an applicator nozzle 32, projects to the direct vicinity of the inner surface of the end wall of the turning cap 20. The applicator nozzle 32, injection molded in one piece with the dividing plug 30, is hollow, its interior opening into the bottom container chamber 16 through the separating plug 30. At the opposite, upper end of the applicator nozzle 32 the cavity terminates in an applicator orifice 34 of small diameter. A plug 36 projecting from the inner surface of the end wall of the turning cap 20 fits into the applicator orifice and—initially—prevents the escape of the preparation component 38 contained in the lower container chamber 16.

The upper end of the applicator nozzle 32 enters into a cylindrical annular projection 40 extending concentrically with the annular wall 28 from the inside of the turning cap end wall, and an internal spiral thread is formed in its inside surface adjoining the end wall and is engaged in a complementary external spiral thread provided on the outer surface of the applicator nozzle 32. In FIG. 1 only one spiral 42 of the internal thread of the annular projection can be seen, while the external thread of the applicator nozzle 32 is represented in the form of the projections 44 extending radially from the outer surface of the applicator nozzle and offset in height from one another on opposite sides.

The section of the applicator nozzle 32 immediately adjoining the separating plug 30 is shown on the outside as a cylindrical sealing surface 46, with which there is associated a complementary cylindrical sealing surface 48 in the free end area of the annular projection 40 remote from the end wall. In the area lying within the projection 40 and bearing the plug 36 the end wall of the turning cap 20 is weakened by an annular score 50 such that the portion of the end wall situated inside of the score will be broken out of the end wall by the applicator nozzle when the applicator nozzle is extended by turning the turning cap 20. The broken-out portion of the end wall thus forms, together with the plug 36, a removable plug for closing the applicator orifice 34 of the applicator nozzle 32.

In order to assure that, when the turning cap 20 is rotated, the applicator nozzle 32 will actually protrude lengthwise of the container through the opening formed by breaking through the end wall portion, to such an extent that the complementary sealing surfaces 46 and 48 will seal against one another, the applicator nozzle 32 as well as the separating plug 30 provided integrally on its bottom end must be prevented from accompanying the rotation of the turning cap 20. This is accomplished in the embodiment represented by the fact that two diametrically opposite, inwardly projecting longitudinal ribs 52 are formed in the circumferential wall of the upper container chamber 18, with which projections 54 extending radially from the circumferential wall of the upper container chamber 18 cooperate. Especially in FIG. 2 it can be seen that, if the applicator nozzle 32 and consequently the separating plug 30 should rotate with the turning cap 20, the projections 54 will abut against the longitudinal ribs 52 after a rotation of less than 180 . Further turning of the applicator nozzle is then prevented, and it is positively driven upwardly from the starting position represented in FIG. 1, and breaks out of the portion of the turning cap within the score 50, in the manner described above.

It will appear from the above description of the configuration of the two-chamber container 10 that it consists of virtually only three parts made from plastic, namely the container 12, the separating plug 30 forming an integral component with the applicator nozzle 32, and the turning cap 20, which can be assembled relatively simply and with little effort.

When the two-chamber container 13 is filled, the procedure will be first to fill the lower container chamber 16 of the container 12 with the prescribed amount of the filling component 38, then pressing the separating plug 30 through the mouth 26 of the upper container chamber 18 into the connecting passage 34. Then the second filling component 56 is packed into the upper container chamber 18, and then the turning cap 20 is snapped over the upper container chamber 18. At the same time the annular wall 36 [sic] then seals in the mouth 26 of the upper container chamber 18 and the plug 36 seals the applicator orifice 34 in the applicator nozzle.

The filling components 38 and 56 are mixed to form the ready-to-use preparation by rotating the turning cap 20 in the sense of an unscrewing of the applicator nozzle 32. The complementary threads 42 and 44 in the annular projection 40 and on the outside of the applicator nozzle 32, respectively, then produce an unscrewing of the applicator nozzle 32 whose free leading end breaks out the portion of the end wall of the turning cap 20 within the score 50. As rotation of the turning cap continues the applicator nozzle 32 is then extended from the opening formed in the end wall, until the complementary sealing surfaces, 46 on the separating plug end of the applicator nozzle 32, and 48 in the bottom end area of the annular projection 40, engage one another. Since in the longitudinal movement of the applicator nozzle 32 the separating plug 30 is drawn out of the connecting passage 14, the filling component 56 passes into the lower container chamber 16 and can be mixed by shaking it with the filling component 38 to form the ready-to-use preparation. This preparation can then be controllingly applied directly with the applicator nozzle 32 after first removing the plug 36 from the applicator orifice 34. The broken portion of the end wall of the turning cap that is still attached to the plug serves then as a handle for the removal of the plug 36.

FIGS. 3 to 6 show desirable further developments beyond the two-chamber container 10 described in conjunction with FIGS. 1 and 2, and these will be described below. Only the pertinent variants are represented, and as far as the basic construction of the two-chamber container is concerned it will suffice to consult the foregoing description, inasmuch as equal parts of both containers are given the same reference numbers in the drawing.

The essential changes relate to the configuration of the turning cap 20 in the area of the annular projection 40 and the free end of the applicator nozzle 32 situated within the annular projection 40 when the two-chamber container 10 is in the closed state. As already described, the free end of the applicator nozzle 32 is deployed from the upper container chamber 16 by rotating the turning cap, while at the same time the separating plug 30 is drawn out of the connecting passage 14 between the upper and lower container chambers 16 and 18. While for this purpose in the embodiment shown in FIGS. 1 and 2 a thread 42 is formed in the annular projection 40 and is complementary to the external thread 44 of the applicator nozzle, in the case of the further-developed turning cap 20, as it can be seen in FIG. 3, instead of the thread 42 a circumferential, radially projecting ledge 43 is created by injection molding, which reduces the inside diameter of the annular projection 40 (at the ledge) to a dimension which is approximately equal to the root diameter of the external thread of the applicator nozzle 32. The free front end 33 of the applicator nozzle 32 (FIGS. 4 and 5) has a diameter which at first is smaller than the inside diameter remaining within the ledge 43, but then increases to a diameter in the area provided with the external thread 44 which corresponds approximately to the inside diameter of the ledge. The length of the applicator nozzle 32 is made such that, in the proper filled and sealed state of the two-chamber container 10, it reaches so far into the interior of the annular projection 40 that the first thread spiral of the outside diameter 44 is still above the ledge 43. That is to say, when the turning cap is installed by placing it vertically onto the (filled) upper container chamber 16, first the conical front end 33 of the applicator nozzle 32 passes through the ledge 43 into the annular projection 40 until the first spiral of the external thread 44 abuts against the ledge 43. As the pressing on of the turning cap continues, the thread spiral in the area of contact then deforms the ledge 43 in the manner indicated in broken lines in FIG. 3, and then the originally radially circumferential ledge is formed into one spiral of the counter-thread of the external thread 44, i.e., when the turning cap 20 now installed in the intended sealing position is turned in the screwdriving direction the external thread 44, thrusting against the deformed ledge, drives itself into the annular projection 40 and the free front end 33 of the applicator nozzle 32 passes through the end wall of the turning cap 20. To permit this penetration the end wall has in the area situated above the annular projection 40 an opening 51, and when the container 10 is in the filled and sealed state this opening 51 is closed by the separate stopper 35 shown in FIG. 6, from which, as in the embodiment shown in FIGS. 1 and 2, a plug 36 fits into the applicator orifice 34 of the applicator nozzle 32. Therefore, as long as the stopper 35 is not removed, the plug 36 prevents the escape of the filling component contained in the lower container chamber, and when the applicator nozzle 32 has been deployed it prevents the escape of the preparation made from the two filling components.

When the applicator nozzle 32 is in the deployed position in the turning cap 20, the cylindrical sealing surface 46 serves to seal off the applicator nozzle 32 in its base area adjoining the separating plug, but its associated counter-sealing surface 48 is now formed in the turning cap 20 in a separate second annular projection 49 which is of greater diameter than the annular projection 40.

It is apparent that modifications and further developments of the above-described two-chamber container 10 can be made within the scope of the invention. Thus it is to be pointed out, only by way of example, that the turning cap 20 does not have to overlap completely the upper container chamber in the manner shown in the embodiment, but that basically a configuration can be achieved in which the circumferential wall will be shorter or lower, in which case the rotatable but axially undisplaceable mounting of the turning cap 20 on the upper container chamber 18 can then be formed by one or more projections corresponding to the catch means 22 which extend from the inside of the circumferential wall of the turning cap and which catch in a circumferential, annular groove-like recess in the wall of the upper container chamber 18.

I claim:

1. A two-chamber container (10), in which two separate filling components are to be mixed to form a ready-to-use preparation prior to dispensing from the container, and which are contained in two container chambers (16; 18) an upper container chamber and a lower container chamber, disposed one above the other in a container case, the upper and lower container chambers being connected together by a connecting passage (14) which opens in an upper side of the lower container and in a bottom surface of the upper container chamber and said connecting passage (14) being closed by a separating plug (30) which is displaceable into one of the container chambers (16; 18) by a plunger element that is displaceable in a vertical direction from outside of said container, so that the filling components can flow together within said container and be mixed with one another within said container, comprising the plunger element is formed as an elongated hollow applicator nozzle (32) extending through the upper container chamber (18) into an open mouth (26) of said upper container chamber, whose hollow interior opens at the bottom end through the separating plug (30) into the lower container chamber (16) and at the upper end terminates in an applicator orifice (34), the plunger element having an exterior provided with an external thread (44) which is in engagement with a complementary counter-thread (42) which is formed in a cylindrical annular projection extending from the end wall of a turning cap (20) which at least partially overlays the upper container chamber (18), is held rotatably thereon, and seals it, into the open top of the upper container chamber (18), that the portion of the end wall of the turning cap (20) situated within the annular projection (40) is configured so that, when the turning cap (20) is rotated in a sense of screwing the applicator nozzle (32) into the annular projection (40), the applicator nozzle can be pushed out of the end wall by the free end of the applicator nozzle (32), and that the section of the applicator nozzle (32) directly adjoining the separating plug (30) has an external sealing surface (46) which, when the applicator nozzle (32) is in the fully deployed position, seals against a complementary sealing surface (48) formed on the annular projection (40).

2. A container according to claim 1, wherein cooperating abutment means are provided on the separating plug (30) and in the upper container chamber which prevent co-rotation of the separating plug (30) and of the applicator nozzle (32) connected thereto, when the turning cap (20) is rotated.

3. A container according to claim 2, wherein the abutment means have at least one projection (54) extending from the separating plug (30) substantially radially to the circumferential wall of the upper container chamber, and at least one rib (52) projecting inwardly from the circumferential wall of the upper container chamber (18) and reaching substantially over its entire height, against which the radial projection (54) of the separating plug (30) abuts upon a rotatory movement.

4. A container according to any one of claims 1 to 3, wherein the container (12) is made in one piece from plastic by the blow-molding process.

5. A container according to claim 1, wherein the turning cap (20) completely overlaps the upper container chamber (18) and has at its bottom end at least one radially inwardly projecting catch means (22) catching on the bottom of the upper container chamber (18).

6. A container according to claim 5, wherein the upper container chamber (18) has in the area of the transition from its bottom to the circumferential wall a circumferential annular bead (24) caught by the catch means (22).

7. A container according to claim 1, wherein the turning cap (20) has an annular wall (28) projecting from the inside surface of its end wall into the mouth (26) of the upper container chamber (18) and sealing this mouth in the manner of a hollow stopper.

8. A container according to claim 1, wherein the turning cap (20) is injection molded from plastic and the portion of the end wall which can be pressed out when the applicator nozzle (32) is screwed out of the turning cap (20) is an integral part of the turning cap end wall enclosed by an annularly circumferential score (50).

9. A container according to claim 8, wherein a plug (36) projects into the applicator orifice (34) of the applicator nozzle (32) from the inside surface facing the applicator nozzle (32) of the removable part of the turning cap end wall.

10. A container according to claim 1, wherein the separating plug (30) and the applicator nozzle (32) are injection molded in one piece from plastic.

11. A container according to claim 1, wherein the outer sealing surface (46) of the applicator nozzle (32) immediately adjoining the separating plug, and the complementary sealing surface (48) formed in the annular projection (40) of the turning cap (20), are substantially cylindrical, the diameter of the sealing surface (46) formed on the applicator nozzle (32) being at least equal to, preferably slightly greater than, the inside diameter of the sealing surface (48) formed in the annular projection (40).

12. A container according to claim 1, wherein the applicator nozzle (32) has on its applicator orifice end before the section provided with external thread a conically tapering section (33), that a radially circumferential ledge (43) projects from the inner wall of the annular projection (40) to such an extent that the inside diameter remaining within the annular projection (40) in the area of the ledge (43) is approximately equal to or slightly smaller than the root diameter of the external thread (44) of the applicator nozzle (32), and that the ledge (43) projects from the inner wall of the annular projection (40) in an area situated below the unthreaded tapered section (33) of the applicator nozzle (32) when the turning cap (20) is properly installed and the container chambers (16; 18) are shut off from one another by the separating plug (30).

13. A container according to claim 12, wherein the end wall of the turning cap (20) has an opening (51) in the area of the annular projection (40) provided on the inside, and that the opening (51) is closed by a stopper (35) which can be forced out of the opening (51) by the free end of the applicator nozzle (32) when the latter is deployed.

14. A container according to claim 13, wherein a plug (36) fitting into the applicator orifice (34) of the applicator nozzle (32) projects from the inside surface of the stopper (35) facing the applicator nozzle (32).

15. A container according to any one of claims 12 to 14, wherein the sealing surface (48) complementary to the outer sealing surface (46) at the base of the applicator nozzle (32) is formed in the turning cap (20) by the inner surface of a second annular projection (49) of enlarged diameter extending from the inside of the end wall of the turning cap (49).

* * * * *